US012060670B2

(12) United States Patent
Kellow

(10) Patent No.: US 12,060,670 B2
(45) Date of Patent: Aug. 13, 2024

(54) WASHING MACHINE APPLIANCES AND METHODS FOR ADDRESSING OUT-OF-BALANCE STATES

(71) Applicant: Haier US Appliance Solutions, Inc., Wilmington, DE (US)

(72) Inventor: Jeffrey Kellow, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 554 days.

(21) Appl. No.: 17/245,849

(22) Filed: Apr. 30, 2021

(65) Prior Publication Data

US 2022/0349103 A1 Nov. 3, 2022

(51) Int. Cl.

| | |
|---|---|
| ***D06F 33/40*** | (2020.01) |
| ***D06F 23/04*** | (2006.01) |
| ***D06F 33/48*** | (2020.01) |
| ***D06F 34/16*** | (2020.01) |
| ***D06F 103/26*** | (2020.01) |
| ***D06F 105/48*** | (2020.01) |
| ***D06F 105/58*** | (2020.01) |

(52) U.S. Cl.

CPC ..... *D06F 33/40* (2020.02); *D06F 23/04* (2013.01); *D06F 33/48* (2020.02); *D06F 34/16* (2020.02); *D06F 2103/26* (2020.02); *D06F 2105/48* (2020.02); *D06F 2105/58* (2020.02)

(58) Field of Classification Search

CPC ..... D06F 33/40; D06F 33/48; D06F 34/16; D06F 2103/26

See application file for complete search history.

(56) References Cited

U.S. PATENT DOCUMENTS

| | | | |
|---|---|---|---|
| 7,581,272 | B2 | 9/2009 | Slabbekoorn |
| 7,958,585 | B2 | 6/2011 | Buendia |
| 9,267,226 | B2 | 2/2016 | Suel, II |

(Continued)

FOREIGN PATENT DOCUMENTS

| | | | |
|---|---|---|---|
| CN | 110629453 | A | 12/2019 |
| JP | 2005230315 | A * | 9/2005 |

(Continued)

OTHER PUBLICATIONS

KR2020121643A Machine Translation (Year: 2020).*
WO2017004787A1 Machine Translation (Year: 2017).*
JP2005230315A Machine Translation (Year: 2005).*

*Primary Examiner* — Spencer E. Bell
(74) *Attorney, Agent, or Firm* — Dority & Manning, P.A.

(57) ABSTRACT

A washing machine appliance may include a cabinet, a tub, a wash basket, and a controller. The tub may be positioned within the cabinet. The tub may define a tub outlet and a tub inlet. The wash basket may be rotatably mounted within the tub. The wash basket may define a chamber for receipt of articles for washing. The controller may be mounted to the cabinet and configured to initiate a washing operation. The washing operation may include flowing a volume of liquid to the tub, initiating a spin phase requiring rotation of the wash basket following flowing the volume of liquid to the tub, determining an out-of-balance (OOB) state within the wash basket, determining a user OOB preference following determining the OOB state, and adjusting the spin phase according to the determined user OOB preference.

19 Claims, 4 Drawing Sheets

(56) References Cited

U.S. PATENT DOCUMENTS

| | | | | |
|---|---|---|---|---|
| 9,328,451 | B2 | 5/2016 | Didat | |
| 2004/0060123 | A1* | 4/2004 | Lueckenbach | D06F 34/14 68/12.02 |
| 2005/0257397 | A1* | 11/2005 | Woerdehoff | D06F 34/28 34/495 |
| 2015/0284895 | A1 | 10/2015 | Davis | |
| 2020/0010999 | A1 | 1/2020 | Cha | |

FOREIGN PATENT DOCUMENTS

| | | | | | |
|---|---|---|---|---|---|
| KR | 2020121643 | A | * | 10/2020 | |
| WO | WO-2017004787 | A1 | * | 1/2017 | D06F 33/02 |

* cited by examiner

WASHING MACHINE APPLIANCES AND METHODS FOR ADDRESSING OUT-OF-BALANCE STATES

FIELD OF THE INVENTION

The present subject matter relates generally to washing machine appliances, and more particularly to features and methods for addressing imbalances or out-of-balance states.

BACKGROUND OF THE INVENTION

Washing machine appliances generally include a wash basket rotatably mounted within a tub of a cabinet. The wash basket defines a wash chamber for receiving articles for washing. During operation of washing machine appliances, wash fluid is directed into the tub and onto articles within the wash chamber of the wash basket. The motor can rotate the wash basket at various speeds to agitate articles within the wash chamber in wash fluid, to wring wash fluid from articles within the wash chamber, etc.

In particular, after the articles of clothing have been washed, the washing machine can drain the wash fluid and then spin the wash basket at a high speed in order to relieve the articles of clothing of remaining moisture and fluid. This process is generally known as a spin cycle, spin phase, or a spin out process.

In certain circumstances, prior to a spin cycle, the load in the washing machine can become imbalanced. In particular, the articles of clothing can become disproportionately distributed towards a single location and form an out-of-balance (OOB) mass. For example, the articles of clothing can adhere together at a single location. The existence of an OOB mass may generally create an OOB state within the wash basket.

Such load imbalance can cause a number of problems if it remains uncorrected and present during the spin cycle. In particular, the imbalance can alter the center of mass for the wash basket and load as a whole so that the center of mass is no longer aligned with a shaft center of the washing machine. Rotating the wash basket at high speeds, for example during a spin cycle, in such condition can cause undesirable vibration, noise, or other damage to system components, including damage caused by the wash basket becoming so far misaligned that is strikes the washing machine cabinet.

Some existing appliances have attempted to address imbalances or OOB states by automatically attempting to redistribute articles within the wash basket. Conventionally, such actions may consume or require significant time, water, or energy from the washing machine appliance. Moreover, they may be ultimately unsuccessful in correcting the imbalance. Some users may become frustrated that a washing operation does not finish within an expected amount of time or that it increases utility costs.

As a result, further improvements would be desirable to provide appliances or methods to address one or more of the above issues. In particular, appliances or methods for permitting a user to selectively and efficiently address imbalances within the washing machine appliance would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance may include a cabinet, a tub, a wash basket, and a controller. The tub may be positioned within the cabinet. The tub may define a tub outlet and a tub inlet. The wash basket may be rotatably mounted within the tub. The wash basket may define a chamber for receipt of articles for washing. The controller may be mounted to the cabinet and configured to initiate a washing operation. The washing operation may include flowing a volume of liquid to the tub, initiating a spin phase requiring rotation of the wash basket following flowing the volume of liquid to the tub, determining an out-of-balance (OOB) state within the wash basket, determining a user OOB preference following determining the OOB state, and adjusting the spin phase according to the determined user OOB preference.

In another exemplary aspect of the present disclosure, a method of operating a washing machine appliance is provided. The method may include flowing a volume of liquid to a tub, initiating a spin phase requiring rotation of a wash basket following flowing the volume of liquid to the tub, determining an out-of-balance (OOB) state within the wash basket, determining a user OOB preference following determining the OOB state, and adjusting the spin phase according to the determined user OOB preference.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
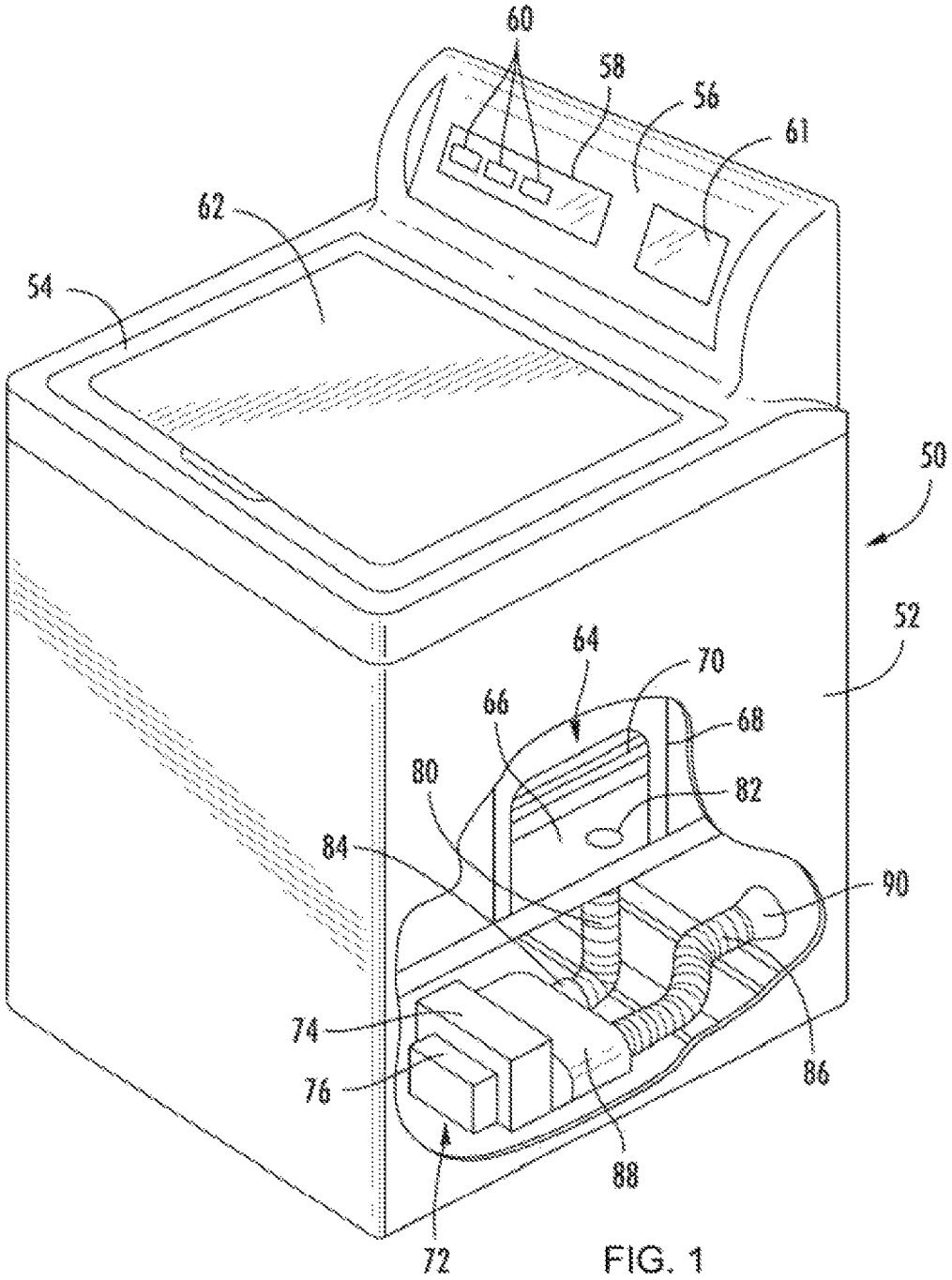
FIG. 1 provides a front, elevation view of a washing machine appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

FIG. 1 provides a perspective view partially broken away of a washing machine appliance 50 according to an exemplary embodiment of the present disclosure. As may be seen in FIG. 1, washing machine appliance 50 includes a cabinet 52 and a cover 54. A backsplash 56 extends from cover 54, and a control panel 58, including a plurality of input selectors 60, is coupled to backsplash 56. Control panel 58 and input selectors 60 collectively form a user interface input for operator selection of machine cycles and features, and in one embodiment a display 61 indicates selected features, a countdown timer, and other items of interest to machine users. A lid 62 is mounted to cover 54 and is rotatable about a hinge (not shown) between an open position (not shown) facilitating access to a wash tub 64 located within cabinet 52, and a closed position (shown in FIG. 1) forming an enclosure over wash tub 64.

As illustrated in FIG. 1, washing machine appliance 50 is a vertical axis washing machine appliance. While the present disclosure is discussed with reference to an exemplary vertical axis washing machine appliance, those of ordinary skill in the art, using the disclosures provided herein, should understand that the subject matter of the present disclosure is equally applicable to other washing machine appliances.

Tub 64 includes a bottom wall 66 and a sidewall 68. Moreover, a wash basket 70 is rotatably mounted within wash tub 64. In some embodiments, a pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

Figure 2:
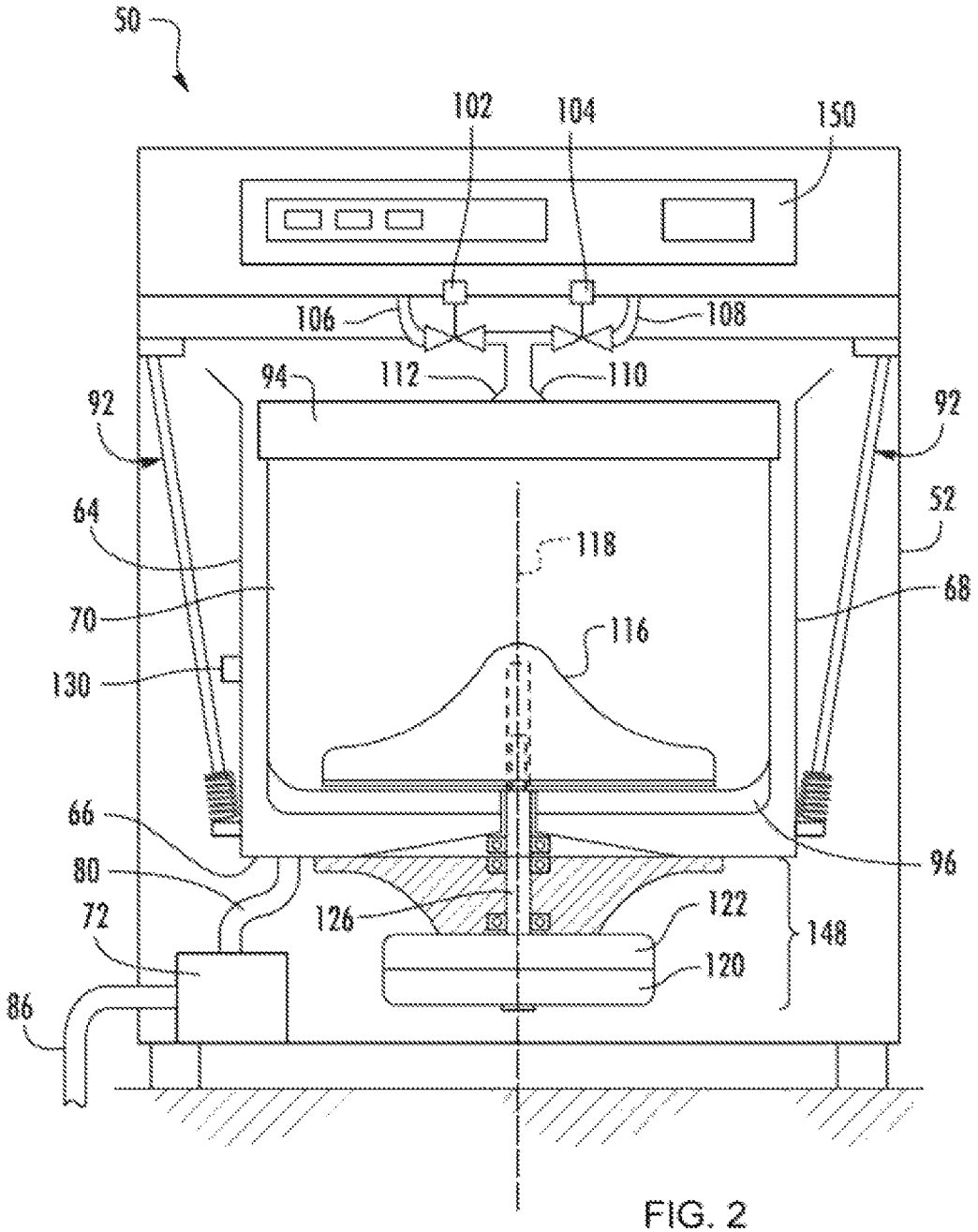
FIG. 2 provides a side, sectional view of the exemplary washing machine appliance of FIG. 1.

FIG. 2 provides a front elevation schematic view of certain components of washing machine appliance 50 including wash basket 70 movably disposed and rotatably mounted in wash tub 64 in a spaced apart relationship from tub sidewall 68 and tub bottom 66. Basket 70 includes a plurality of perforations therein to facilitate fluid communication between an interior of basket 70 and wash tub 64.

In some embodiments, a hot liquid valve 102 and a cold liquid valve 104 deliver liquid, such as water, to basket 70 and wash tub 64 through a respective hot liquid hose 106 and cold liquid hose 108. Liquid valves 102, 104 and liquid hoses 106, 108 together form a liquid supply connection for washing machine appliance 50 and, when connected to a building plumbing system (not shown), provide a fresh water supply for use in washing machine appliance 50. Liquid valves 102, 104 and liquid hoses 106, 108 are connected to a basket inlet tube 110, and liquid is dispersed from inlet tube 110 through a nozzle assembly 112 having a number of openings therein to direct washing liquid into basket 70 at a given trajectory and velocity. A dispenser (not shown in FIG. 2), may also be provided to produce a liquid or wash solution by mixing fresh water with a known detergent or other additive for cleansing of articles in basket 70.

As illustrated, an agitation element 116, such as a vane agitator, impeller, auger, or oscillatory basket mechanism, or some combination thereof, may be disposed in basket 70 to impart an oscillatory motion to articles and liquid in basket 70. In various exemplary embodiments, agitation element 116 may be a single action element (oscillatory only), double action (oscillatory movement at one end, single direction rotation at the other end) or triple action (oscillatory movement plus single direction rotation at one end, single direction rotation at the other end). As illustrated, agitation element 116 is oriented to rotate about a vertical axis 118.

Basket 70 and agitation element 116 are driven by a motor 120 through a transmission and clutch system 122. The motor 120 drives shaft 126 to rotate basket 70 within wash tub 64. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Motor 120 and transmission and clutch system 122 collectively are referred herein as a motor assembly 148.

Basket 70, tub 64, and motor assembly 148 are supported by a vibration dampening suspension system. The dampening suspension system can include one or more suspension assemblies 92 coupled between and to the cabinet 52 and wash tub 64. Typically, four suspension assemblies 92 are utilized, and are spaced apart about the wash tub 64. For example, each suspension assembly 92 may be connected at one end proximate a corner of the cabinet 52 and at an opposite end to the wash tub 64. The washer can include other vibration dampening elements, such as a balance ring 94 disposed around the upper circumferential surface of the wash basket 70. The balance ring 94 can be used to counterbalance an out of balance condition for the wash machine as the basket 70 rotates within the wash tub 64. The wash basket 70 could also include a balance ring 96 located at a lower circumferential surface of the wash basket 70.

A dampening suspension system generally operates to dampen dynamic motion as the wash basket 70 rotates within the tub 64. The dampening suspension system has various natural operating frequencies of the dynamic system. These natural operating frequencies are referred to as the modes of suspension for the washing machine. For instance, the first mode of suspension for the washing machine occurs when the dynamic system including the wash basket 70, tub 64, and suspension system are operating at the first resonant or natural frequency of the dynamic system.

Operation of washing machine appliance 50 is controlled by a controller 150 that is operatively coupled (e.g., electrically coupled or connected) to the user interface input located on washing machine backsplash 56 for user manipulation to select washing machine cycles and features. In response to user manipulation of the user interface input, controller 150 operates the various components of washing machine appliance 50 to execute selected machine cycles and features.

Controller 150 may include a memory (e.g., non-transitory storage media) and microprocessor, such as a general or special purpose microprocessor operable to execute programming instructions or micro-control code associated with a washing operation or cycle. The memory may represent random access memory such as DRAM, or read only memory such as ROM or FLASH. In one embodiment, the processor executes programming instructions stored in memory (e.g., as software). The memory may be a separate component from the processor or may be included onboard within the processor. Alternatively, controller 150 may be constructed without using a microprocessor (e.g., using a combination of discrete analog or digital logic circuitry; such as switches, amplifiers, integrators, comparators, flip-flops, AND gates, and the like) to perform control functionality instead of relying upon software. Control panel 58 and other components of washing machine appliance 50 (such as motor assembly 148 and measurement devices 130) may be in communication with controller 150 via one or more signal lines or shared communication busses to provide signals to or receive signals from the controller 150. Optionally, a measurement device 130 may be included with controller 150. Moreover, measurement devices 130 may include a microprocessor that performs the calculations specific to the measurement of motion with the calculation results being used by controller 150.

In specific embodiments, one or more measurement devices 130 are provided in the washing machine appliance 50 for measuring movement of the tub 64 during one or more portions of an operative cycle (e.g., a wash cycle, rinse cycle, spin cycle, etc.). Generally, movement may be measured as one or more angular positions, speeds, or accelerations, detected at the one or more measurement devices 130. Measurement devices 130 may measure a variety of suitable variables, which can be correlated to movement of the tub 64. The movement measured by such devices 130 can be utilized to monitor the load balance state of the tub 64 (e.g., during a spin cycle), and to facilitate movement or acceleration in particular manners or for particular time periods to prevent damage or undesired operations.

A measurement device 130 may include an accelerometer which measures translational motion, such as acceleration along one or more directions. Additionally or alternatively, a measurement device 130 may include a gyroscope, encoder, or other measurement devices, which measures rotational motion, such as rotational velocity about an axis. In some embodiments, measurement device 130 is mounted to the tub 64 (e.g., bottom wall 66 or a sidewall 68 thereof) to sense movement of the tub 64 relative to the cabinet 52 by measuring uniform periodic motion, non-uniform periodic motion, or excursions of the tub 64 during appliance 50 operation. In additional or alternative embodiments, measurement device 130 is mounted to a separate portion of appliance 50 (e.g., on or within backsplash 56) to sense movement of the cabinet 52 by measuring uniform periodic motion, non-uniform periodic motion, or excursions during appliance 50 operation.

In exemplary embodiments, a measurement device 130 may include at least one gyroscope or at least one accelerometer. The measurement device 130, for example, may be a printed circuit board which includes the gyroscope and accelerometer thereon. The measurement device 130 may be mounted to the tub 64 (e.g., via a suitable mechanical fastener, adhesive, etc.) and may be oriented such that the various sub-components (e.g., the gyroscope and accelerometer) are oriented to measure movement along or about particular directions. Notably, the gyroscope and accelerometer in exemplary embodiments may be mounted to the tub 64 at a single location (e.g., the location of the printed circuit board or other component of the measurement device 130 on which the gyroscope and accelerometer are grouped). Alternatively, however, the gyroscope and accelerometer need not be mounted at a single location. For example, a gyroscope located at one location on tub 64 can measure the rotation of an accelerometer located at a different location on tub 64, because rotation about a given axis is the same everywhere on a solid object such as tub 64.

Irrespective of the exact location of monitoring device 130, movement signals from the measurement device 130 may be received and analyzed to determine an out-of-balance load or state, as is understood.

Separate from, or in addition to, detecting movement of tub 64 via measurement device 130, it is understood that imbalances may be detected according to signals detected at the motor 120. For instance, when a load becomes imbalanced, rotation of the wash basket 70 at high speeds can cause undesirable vibration. In turn, imbalanced loads can result in a periodic variation being exhibited by the speed of the motor 120. In particular, the speed of the motor may increase and decrease periodically due to the imbalanced forces caused by the imbalanced load. For example, the speed of the motor 120 may change at a uniform periodic rate as an out of balance load, balancing ring mass and other rotating parts dynamically interact with the non-rotating masses and the wash tub suspension 92. Such variations in speed may be detected (e.g., via a Hall effect sensor mounted to motor 120) to determine an 00B state, as would be understood In an illustrative embodiment, laundry items are loaded into basket 70, and washing operation is initiated through operator manipulation of control input selectors 60 (FIG. 1). Tub 64 is filled with liquid such as water and mixed with detergent to form a wash fluid, and basket 70 is agitated with agitation element 116 for cleansing of laundry items in basket 70. That is, agitation element 116 is moved back and forth in an oscillatory back and forth motion about vertical axis 118, while basket 70 remains generally stationary (i.e., not actively rotated).

In exemplary embodiments, agitation element 116 is rotated clockwise a specified amount about the vertical axis 118 of the machine, and then rotated counterclockwise by a specified amount. The clockwise/counterclockwise reciprocating motion is sometimes referred to as a stroke, and the agitation phase of the wash cycle constitutes a number of strokes in sequence. Acceleration and deceleration of agitation element 116 during the strokes imparts mechanical energy to articles in basket 70 for cleansing action. The strokes may be obtained in different embodiments with a reversing motor, a reversible clutch, or other known reciprocating mechanism. After the agitation phase of the wash cycle is completed, tub 64 is drained with pump assembly 72. Laundry articles can then be rinsed by again adding liquid to tub 64. Depending on the particulars of the cleaning cycle selected by a user, agitation element 116 may again provide agitation within basket 70.

After a rinse cycle, tub 64 is again drained, such as through use of pump assembly 72. After liquid is drained from tub 64, one or more spin cycles may be performed. In particular, a spin cycle or phase may be applied after the agitation phase or after the rinse phase in order to wring excess wash fluid from the articles being washed. During a spin cycle, basket 70 is rotated at relatively high speeds about vertical axis 118, such as between approximately 450 and approximately 1300 revolutions per minute.

Figure 3:
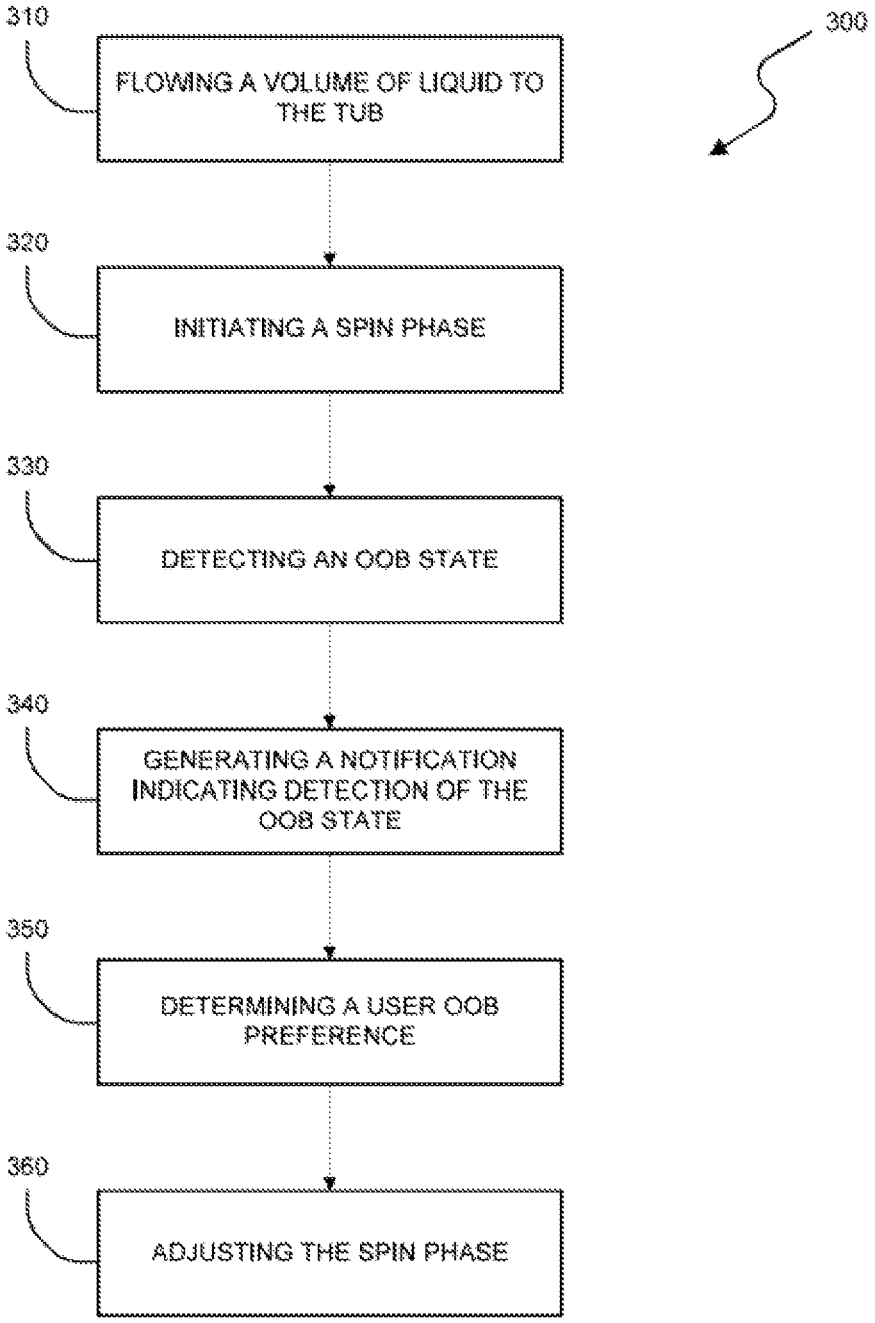
FIG. 3 provides a flow chart illustrating a method of operating a washing machine appliance according to exemplary embodiments of the present disclosure.
Figure 4:
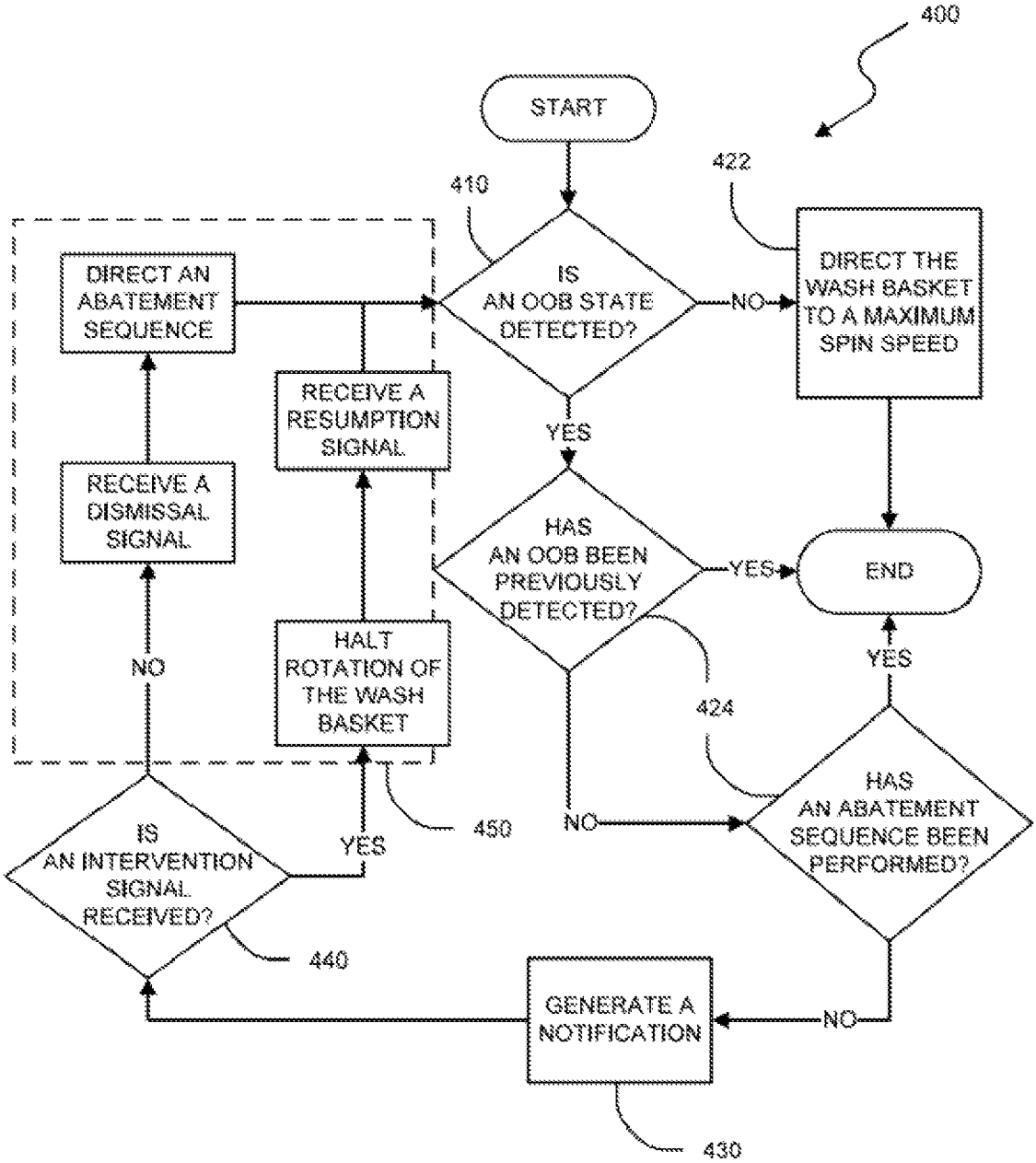
FIG. 4 provides a flow chart illustrating a method of operating a washing machine appliance according to exemplary embodiments of the present disclosure.

Referring now to FIGS. 3 and 4, various methods may be provided for use with washing machine appliances (e.g., washing machine appliance 50) in accordance with the present disclosure. In general, the various steps of methods as disclosed herein may, in exemplary embodiments, be performed by the controller 150 as part of a washing operation that the controller 150 is configured to initiate (e.g., including a wash cycle, a rinse cycle, a spin cycle, etc.). During such methods, controller 150 may receive inputs and transmit outputs from various other components of the appliance 50. For example, controller 150 may send signals to and receive signals from motor assembly 148 (including the motor 120), control panel 58, one or more measurement device 130, pump assembly 72, or valves 102, 104. In particular, the present disclosure is further directed to methods, as indicated by reference numbers 300 and 400, for operating washing machine appliance. Such methods advantageously facilitate monitoring of and addressing load balance states, detection of out-of-balance conditions, and reduction of out-of-balance conditions when detected. In exemplary embodiments, such balancing is performed during a spin cycle or phase.

FIGS. 3 and 4 depict steps performed in a particular order for purpose of illustration and discussion. Those of ordinary skill in the art, using the disclosures provided herein, will understand that (except as otherwise indicated) the steps of any of the methods disclosed herein can be modified, adapted, rearranged, omitted, or expanded in various ways without deviating from the scope of the present disclosure.

Turning specifically to FIG. 3, a method 300 is illustrated. At 310, the method 300 includes flowing a volume of a liquid into the tub. The liquid may include water, and may further include one or more additives as discussed above. The water may be flowed through the hot liquid hose or cold liquid hose, the basket inlet tube, and nozzle assembly into the tub and onto articles that are disposed in the basket for washing. The volume of liquid may be dependent upon the size of the load of articles and other variables which may, for example, be input by a user interacting with the control panel and input selectors thereof.

At 320, the method 300 includes initiating a spin phase. For instance, 320 may include rotating or spinning the basket at a set dwell speed. In some such embodiments, the motor rotates the basket within tub at the set dwell speed (e.g., in rotations per minute), either indefinitely (e.g., contingent on a time-independent variable) or for a predetermined time period (i.e., a predetermined amount of time). Optionally, the basket may be maintained at the set dwell speed or otherwise at a lower speed, which is less than a predetermined maximum spin speed of the spin cycle.

As would be understood, 320 follows 310 and one or more other cycles, such as a wash cycle, rinse cycle, drain cycle, etc. Optionally, the pump assembly may draw water (e.g., at least a portion of the volume of liquid from 310) away from the tub before rotation begins.

At 330, the method 300 includes detecting an out-of-balance (OOB) state within the basket. Generally, any suitable method for detecting an imbalance or OOB state in which the center of mass of the basket (and articles therein) is no longer aligned with a shaft center of the washing machine may be used. As an example, the OOB state may be detected based on more received signals from a measurement device (e.g., accelerometer or gyroscope) during rotation of the basket (e.g., during the spin phase). As an additional or alternative example, the OOB may be detected based on one or more received signals from the basket's motor (e.g., or a sensor thereof). Such examples are generally understood in the art and should be considered within the scope of 330.

At 340, the method 300 includes generating a notification indicating the determined OOB state in response to 330. For instance, a light may be activated or a message may be generated at the user interface to alert a user that an imbalance (i.e., OOB state) has been detected. Additionally or alternatively, an audible alert may be generated from a speaker (e.g., included with the user interface or a connected device).

At 350, the method 300 includes determining a user OOB preference following 340. In some embodiments, 350 occurs during the spin phase. In other words, 350 may occur while the spin phase is being performed (e.g., during rotation of the basket) and, thus, following the 330 and 340.

In certain embodiments, 350 can indicate a user's preference for how and when to address the OOB state. As an example, a user may wish for the washing machine appliance to attempt to address the OOB state (e.g., without direct user effort or engagement with the articles within the basket). To that end, 350 may include receiving a dismissal input signal. In some embodiments, the dismissal signal may be received from the user interface (e.g., following 340 or prior to 330, such as with an initial selection of the washing operation). Such a dismissal signal may indicate, for example, that a user has engaged or pressed an input corresponding to an abatement or rebalancing sequence. In additional or alternative embodiments, the dismissal signal may be received from a timer (e.g., included with the controller) indicating expiration of a predetermined time period following 340. In other words, the timer may begin measuring or counting down the predetermined time period in response to 340. Once the predetermined time period has expired or lapsed (e.g., in response thereto), the dismissal signal may be transmitted and received (e.g., within the controller).

As another example, a user may wish to manually intervene and attempt rebalancing manually (e.g., by manually rearranging articles within the basket). To that end, 350 may include receiving an intervention input signal. In some embodiments, the intervention signal may be received from the user interface (e.g., following 340 or prior to 330, such as with an initial selection of the washing operation). Such an intervention signal may indicate, for example, that a user has engaged or pressed an input corresponding to halting basket rotation or otherwise temporarily stopping the spin cycle. In additional or alternative embodiments, the intervention signal may be received from a latch assembly or another sensor selectively engaged with the door (e.g., in the closed position), as would be understood. Specifically, the intervention signal may correspond with opening the door from the closed position. Thus, the intervention signal may be transmitted and received following (e.g., in response to) the user opening the door to the wash chamber.

At 360, the method 300 includes adjusting the spin phase according to the determined user OOB preference at 350. In other words, 360 may be directed or otherwise initiated in response to 350. As an example, if the dismissal signal has been received, 360 may include initiating an abatement sequence following reception of the dismissal input signal. Generally, any suitable method for rebalancing articles within the wash basket may be used. For instance, rotation (e.g., speed or direction) of the basket may be changed, such as to dislodge an OOB mass or oscillate the articles within basket.

As another example, if the intervention signal has been received, 360 may include halting rotation of the wash basket. For instance, the motor may be directed to stop or otherwise prevent rotation of the wash basket. If the door has been locked (e.g., by a latch assembly) in the closed position for the spin phase, the door may further be unlocked. Thus, a user may be permitted to access the basket and manually move articles within the wash chamber while the basket is no longer moving or rotating.

Following halting rotation or the spin phase generally, 360 may further include receiving a resumption signal (e.g., from the user interface or consumer device) to indicate a user's desire to proceed with the spin phase. Optionally, the controller may be required to confirm if the OOB state remains. If the OOB state has been cured, the spin phase may be reinitiated (e.g., such that the basket is rotated to a predetermined maximum spin speed). Once reinitiated, the spin phase may continue until completion (e.g., until expiration of one or more timers or, additionally or alternatively, one or more received signals from one or more sensors), as would be understood. By contrast, if the OOB state has not been cured, an abatement sequence may be initiated or the spin phase and washing operation may be prematurely ended.

Turning now to FIG. 4, a method 400 is illustrated. At 410, the method 400 includes evaluating performance of an initiated spin phase (e.g., while the basket rotates within the tub). In particular, it may be determined that either an OOB state is not detected or that an OOB is detected. Generally, any suitable method for detecting an imbalance or OOB state in which the center of mass of the basket (and articles therein) is no longer aligned with a shaft center of the washing machine may be used. As an example, the OOB state may be detected based on more received signals from a measurement device (e.g., accelerometer or gyroscope) during rotation of the basket (e.g., during the spin phase). As an additional or alternative example, the OOB may be detected based on one or more received signals from the basket's motor (e.g., or a sensor thereof). Such examples are generally understood in the art and should be considered within the scope of 410.

As would be understood, 410 follows one or more other cycles, such as a wash cycle, rinse cycle, drain cycle, etc. Optionally, the pump assembly may draw water (e.g., at least a portion of liquid within the tub) away from the tub before rotation begins.

If an OOB is not detected at 410, the method 400 may be permitted to proceed with the spin phase. In particular, the method 400 may proceed to 422. At 422, the method 400 includes directing the wash basket to a maximum spin speed, such as a predetermined plaster speed at which wash fluid is shed from articles within the basket. Following rotation at the maximum spin speed, the spin phase may continue until completion (e.g., until expiration of one or more timers or, additionally or alternatively, one or more received signals from one or more sensors), as would be understood.

If an OOB is detected at 410, the method 400 may be permitted to proceed to 424. At 424, the method 400 includes determining if previous adjustments have been made to the current spin phase. In particular, it may be determined if one or more OOB states have been previously detected or if one or more abatement sequences (e.g., rebalancing attempts) have been performed during the spin phase. If an OOB state has been detected or an abatement sequence has been performed, the method 400 may prematurely end the spin phase and washing operation may be prematurely ended. If an OOB state has not been detected or an abatement sequence has not been performed, the method 400 may be permitted to proceed to 430.

At 430, the method 400 includes generating a notification indicating an OOB state has been detected at 410. For instance, a light may be activated or a message may be generated at the user interface to alert a user that an imbalance (i.e., OOB state) has been detected. Additionally or alternatively, an audible alert may be generated from a speaker (e.g., included with the user interface).

At 440, the method 400 includes determining a user OOB preference (e.g., whether a user wishes to intervene). Specifically, 440 may indicate a user's preference for how and when to address the OOB state. As an example, a user may wish for the washing machine appliance to attempt to address the OOB state (e.g., without direct user input or engagement with the articles within the basket). To that end, 440 may include receiving a dismissal input signal. In some embodiments, the dismissal signal may be received from the user interface (e.g., following 430 or prior to 430, such as with an initial selection of the washing operation). Such a dismissal signal may indicate, for example, that a user has engaged or pressed an input corresponding to an abatement or rebalancing sequence. In additional or alternative embodiments, the dismissal signal may be received from a timer (e.g., included with the controller) indicating expiration of a predetermined time period following 430. In other words, the timer may begin measuring or counting down the predetermined time period in response to 430. Once the predetermined time period has expired or lapsed (e.g., in response thereto), the dismissal signal may be transmitted and received.

As another example, a user may wish to intervene and attempt rebalancing manually (e.g., by personally and directly rearranging articles within the basket). To that end, 440 may include receiving an intervention input signal. In some embodiments, the intervention signal may be received from the user interface (e.g., following 430 or prior to 430, such as with an initial selection of the washing operation). Such an intervention signal may indicate, for example, that a user has engaged or pressed an input corresponding to halting basket rotation or otherwise temporarily stopping the spin cycle. In additional or alternative embodiments, the intervention signal may be received from a latch assembly or another sensor selectively engaged with the door (e.g., in the closed position), as would be understood. Specifically, the intervention signal may correspond with opening the door from the closed position. Thus, the intervention signal may be transmitted and received following (e.g., in response to) the user opening the door to the wash chamber.

At 450, the method 400 includes adjusting the spin phase according to the determined user OOB preference at 440. In other words, 450 may be directed or otherwise initiated in response to 440. As an example, if the dismissal signal has been received, 450 may include initiating and directing an abatement sequence following reception of the dismissal input signal. Generally, any suitable method for rebalancing articles within the wash basket may be used. For instance, rotation (e.g., speed or direction) of the basket may be changed, such as to dislodge an OOB mass or oscillate the articles within basket.

As another example, if the intervention signal has been received, 450 may include halting rotation of the wash basket. For instance, the motor may be directed to stop or otherwise prevent rotation of the wash basket. If the door has been locked (e.g., by a latch assembly) in the closed position for the spin phase, the door may further be unlocked. Thus, a user may be permitted to access the basket and manually move articles within the wash chamber while the basket is no longer moving or rotating. Following halting rotation or the spin phase generally, 450 may further include receiving a resumption signal (e.g., from the user interface or consumer device) to indicate a user's desire to proceed with the spin phase.

After 450, the method 400 may reinitiate the spin phase. In other words, after the abatement sequence has been completed or a resumption signal is received, the wash basket may be again rotated, such as to the dwell speed. Once the spin phase is reinitiated, the method 400 may be returned to 410 to repeat one or more of the above steps, as would be understood in light of the present disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet;

a tub positioned within the cabinet, the tub defining a tub outlet and a tub inlet;

a wash basket rotatably mounted within the tub, the wash basket defining a chamber for receipt of articles for washing; and a controller mounted to the cabinet and configured to initiate a washing operation, the washing operation comprising:

flowing a volume of liquid to the tub, initiating a spin phase requiring rotation of the wash basket following flowing the volume of liquid to the tub, determining an out-of-balance (OOB) state within the wash basket to indicate a center of mass is not aligned with a shaft center, determining an earlier OOB state has not previously been detected during the spin phase, wherein determining the earlier OOB state follows determining the OOB state, generating a notification indicating determining the OOB state in response to determining the OOB state and following determining the earlier OOB state has not been detected, initiating a timer for a predetermined time period of waiting for an intervention signal in response to generating the notification, wherein an abatement sequence is prevented from being initiated during the predetermined time period and planned to be initiated following expiration of the predetermined time period, the abatement sequence comprising steps for rebalancing articles within the chamber after the predetermined time period, determining a user OOB preference following determining the OOB state, the determination of the OOB preference being based on a signal evaluation during or following the predetermined time period of the initiated timer, and adjusting the spin phase according to the determined user OOB preference.

2. The washing machine appliance of claim 1, wherein determining the user OOB preference comprises receiving a dismissal input signal from the timer indicating expiration of the predetermined time period.

3. The washing machine appliance of claim 2, wherein adjusting the spin phase comprises initiating the abatement sequence following receiving the dismissal input signal.

4. The washing machine appliance of claim 1, wherein determining the user OOB preference further comprises receiving a dismissal input signal from a user interface.

5. The washing machine appliance of claim 4, wherein adjusting the spin phase comprises initiating the abatement sequence following receiving the dismissal input signal.

6. The washing machine appliance of claim 1, wherein determining the user OOB preference comprises receiving the intervention input signal from a user interface prior to expiration of the predetermined time period.

7. The washing machine appliance of claim 6, wherein adjusting the spin phase comprises halting rotation of the wash basket.

8. The washing machine appliance of claim 7, wherein adjusting the spin phase further comprises receiving a resumption signal following halting rotation of the wash basket.

9. The washing machine appliance of claim 8, wherein adjusting the spin phase further comprises reinitiating the spin phase in response to receiving the resumption signal.

10. A method of operating a washing machine appliance comprising a cabinet, a tub mounted within the cabinet, and a wash basket rotatably mounted within the tub, the method comprising:

flowing a volume of liquid to the tub;

initiating a spin phase requiring rotation of the wash basket following flowing the volume of liquid to the tub;

determining an out-of-balance (OOB) state within the wash basket to indicate a center of mass is not aligned with a shaft center;

determining an earlier OOB state has not been during the spin phase, wherein determining the earlier OOB state follows determining the OOB state;

generating a notification indicating determining the OOB state in response to determining the OOB state and following determining the earlier OOB state has not been detected;

initiating a timer for a predetermined time period of waiting for an intervention signal in response to generating the notification, wherein an abatement sequence is prevented from being initiated during the predetermined time period and planned to be initiated following expiration of the predetermined time period, the abatement sequence comprising steps for rebalancing articles within the chamber after the predetermined time period;

determining a user OOB preference following determining the OOB state, the determination of the OOB preference being based on a signal evaluation during or following the predetermined time period of the initiated timer; and adjusting the spin phase according to the determined user OOB preference.

11. The method of claim 10, wherein determining the user OOB preference comprises receiving a dismissal input signal from the timer indicating expiration of the predetermined time period.

12. The method of claim 11, wherein adjusting the spin phase comprises initiating the abatement sequence following receiving the dismissal input signal.

13. The method of claim 10, wherein determining the user OOB preference further comprises receiving a dismissal input signal from a user interface.

14. The method of claim 13, wherein adjusting the spin phase comprises initiating the abatement sequence following receiving the dismissal input signal.

15. The method of claim 10, wherein determining the user OOB preference comprises receiving the intervention input signal from a user interface prior to expiration of the predetermined time period.

16. The method of claim 15, wherein adjusting the spin phase comprises halting rotation of the wash basket.

17. The method of claim 16, wherein adjusting the spin phase further comprises receiving a resumption signal following halting rotation of the wash basket.

18. The method of claim 17, wherein adjusting the spin phase further comprises reinitiating the spin phase in response to receiving the resumption signal.

19. The method of claim 10, further comprising:

generating a notification indicating determining the OOB state prior to adjusting the spin phase.

* * * * *